US007861864B2

(12) United States Patent
Hassell et al.

(10) Patent No.: US 7,861,864 B2
(45) Date of Patent: Jan. 4, 2011

(54) BAKERY TRAY

(75) Inventors: Jon P. Hassell, Atlanta, GA (US); William P. Apps, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 753 days.

(21) Appl. No.: 11/561,874

(22) Filed: Nov. 20, 2006

(65) Prior Publication Data

US 2008/0116100 A1 May 22, 2008

(51) Int. Cl.
*B65D 21/00* (2006.01)

(52) U.S. Cl. ..... 206/507; 206/386; 206/504; 206/509; 206/511; 206/557; 220/607

(58) Field of Classification Search ..... 206/386, 206/504, 507, 509, 511, 557; 220/607
See application file for complete search history.

(56) References Cited

U.S. PATENT DOCUMENTS 4,364,477 A 12/1982 Stromberg
4,936,458 A 6/1990 Tabler et al.
2003/0183549 A1* 10/2003 Verna et al. ..... 206/509
2005/0183980 A1* 8/2005 Fernandez et al. ..... 206/509

OTHER PUBLICATIONS

UK Search Report for UK Application No. GB0722623.6, Feb. 18, 2008.

* cited by examiner

*Primary Examiner*—Anthony Stashick
*Assistant Examiner*—Elizabeth Volz
(74) *Attorney, Agent, or Firm*—Carlson, Gaskey & Olds

(57) ABSTRACT

A tray includes a base having opposed front and rear walls and opposed side walls. The front and rear walls are shorter to provide access to products stored on the tray when in a stacked configuration. The trays provide audible feedback when one tray is slid on another when they are properly aligned during a blind stacking operation to confirm the proper alignment. The tray further includes reinforced intersections between the front and rear walls and side walls.

20 Claims, 7 Drawing Sheets

BAKERY TRAY

BACKGROUND OF THE INVENTION

The present invention relates generally to a tray for baked goods,

Existing molded plastic trays for shipping and storing baked goods include opposite side walls extending upwardly from a base. Front and rear walls are lower than the side walls in order to provide access to the baked goods when the trays are stacked. The side walls include rails that permit the trays to slide and interlock with one another for stacking.

In use, the trays, while loaded with baked goods, are often stacked higher than the person stacking and unstacking them. When the person lifts a loaded tray onto a stack above his head, this is known as "blind stacking." The person can set a rear edge of the tray onto a front edge of the top tray on the stack and slide the tray rearward until it interlocks with the top tray. However, with the current trays, if the tray is misaligned with the top tray on the stack and then slid onto the stack, the baked goods on the top tray of the stack may be damaged.

Additionally, in the current trays, some of the projections on the tray that interlock with the upper edges of the tray below are susceptible to breakage. Further, the shorter front and rear walls of the tray reduce the strength of the tray, particularly when supporting hot baked goods. Thus, the current trays are susceptible to breakage.

SUMMARY OF THE INVENTION

A tray, particularly for baked goods, includes a pair of opposite side walls extending upwardly from a base. The front and rear walls are shorter to provide access to the baked goods. The front and rear walls, particularly in the corners intersecting with the side walls are reinforced to prevent breakage and to increase stiffness across the tray.

To aid in the alignment during blind stacking, the upper support surfaces on the side walls are provided with discontinuities, such as small grooves or recesses, which provide audible feedback to the user when a properly aligned tray is being slide across into the interlocked position. Further, some of the interlocking features on the lower end of the side walls are reinforced to prevent breakage. Additionally, improved drainage is provided to areas of the tray, so that the tray is properly drained when being washed.

These and other features of the present invention can be best understood from the following specification and drawings, the following of which is a brief description.

DETAILED DESCRIPTION OF THE PREFERRED EMBODIMENT

Figure 1:
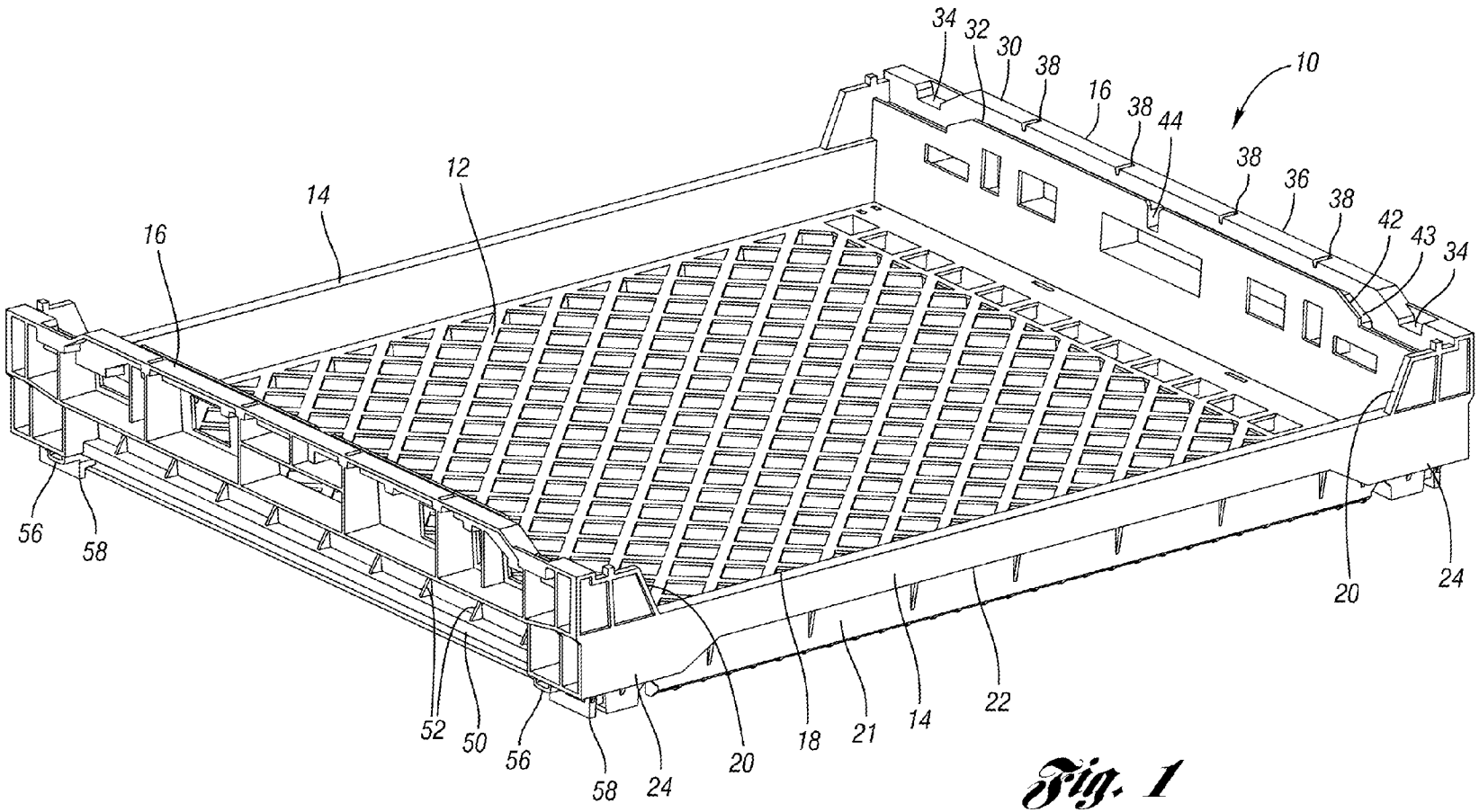
FIG. 1 is a perspective view of a tray according to one embodiment of the present invention.

A tray 10 according to one embodiment of the present invention is shown in FIG. 1. The tray 10 includes a base 12 having front and rear walls 14 and opposite side walls 16. The front and rear walls 14 are shorter than the side walls 16 to create an access window 18, so that the goods stored on the base 12 can be accessed even when additional, similar trays are stacked on the tray 10. Lateral flanges 20 extend inward from the side walls 16, slightly narrowing the windows 18 in order to reinforce the corner intersections between the front and rear walls 14 and the side walls 16.

The front and rear walls 14 each include an inner wall 21 continuous with the base 12 and an outwardly spaced outer wall or lip 22 providing structural reinforcement to the front and rear walls 14. Ribs or gussets connect the inner wall 21 and lip 22. The lip 22 includes enlarged portions 24 proximate the side walls 16. The enlarged portions are part of the tubular or box beam cross-section that extend from the front and rear walls 14 into the corners adjacent the side walls 16. The enlarged portions 24 and box beam cross-sections reinforce the corners of the tray 10 to prevent breakage in corners.

The side walls 16 each include an outer rail 30 and a lower, inner rail 32. The outer rail 30 is continuous with interlocking recesses 34 for mating with feet 56 on a similar tray 10 stacked thereon. The upper surface 36 of the outer rail 30 is continuous with the recesses 34.

A channel defined between the inner rail 32 and the outer rail 30 includes a bottom surface 42 having inclined portions 43. An opening 44 to the interior of the tray 10 interrupts the channel and the inner rail 32 and the surface 42 to provide drainage of the channel when the tray 10 is washed.

On a lower portion of the side walls 16, rounded feet 56 project downwardly and are aligned with the upper surface 36 of the outer rail 30. An inner guide 58 is spaced inwardly from each foot 56 and extends downwardly further than each foot 56. Between the feet 56 and disposed inwardly of the feet 56 is an interlocking rail 50 spaced outwardly from the main wall of the side wall 16. The rail 50 is continuous between the feet 56 and is reinforced by gussets 52.

Figure 2:
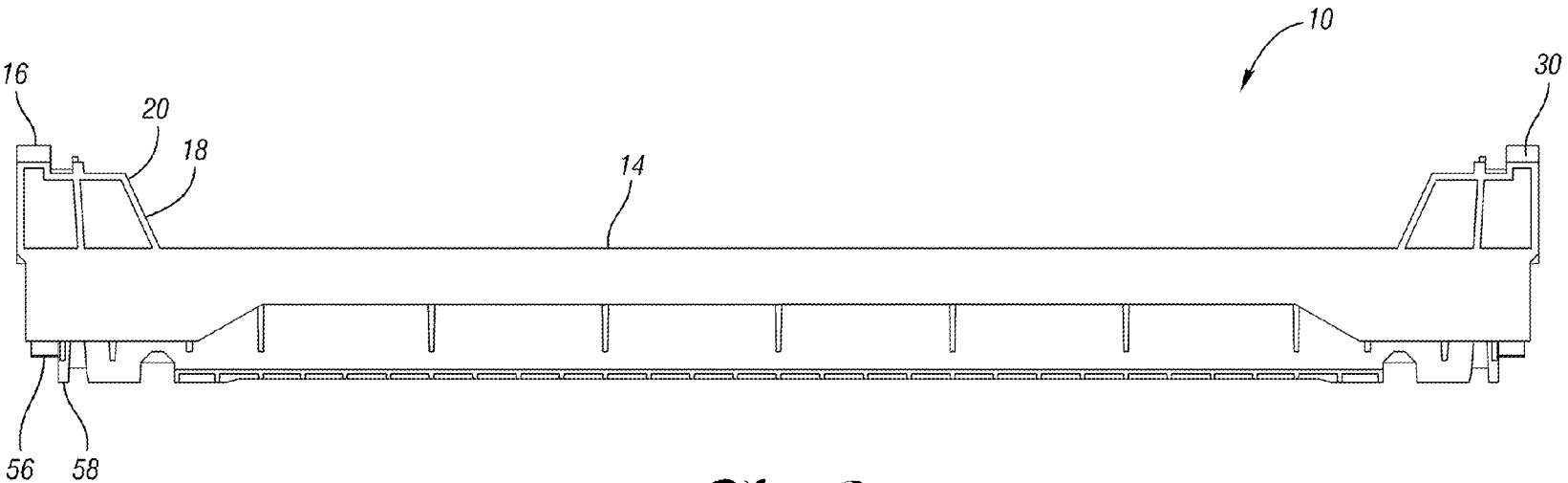
FIG. 2 is a front view of the tray of FIG. 1.

Referring to FIG. 2, the inner guide 58 is spaced inwardly with the foot 56 and extends downwardly further than the foot 56.

Figure 3:
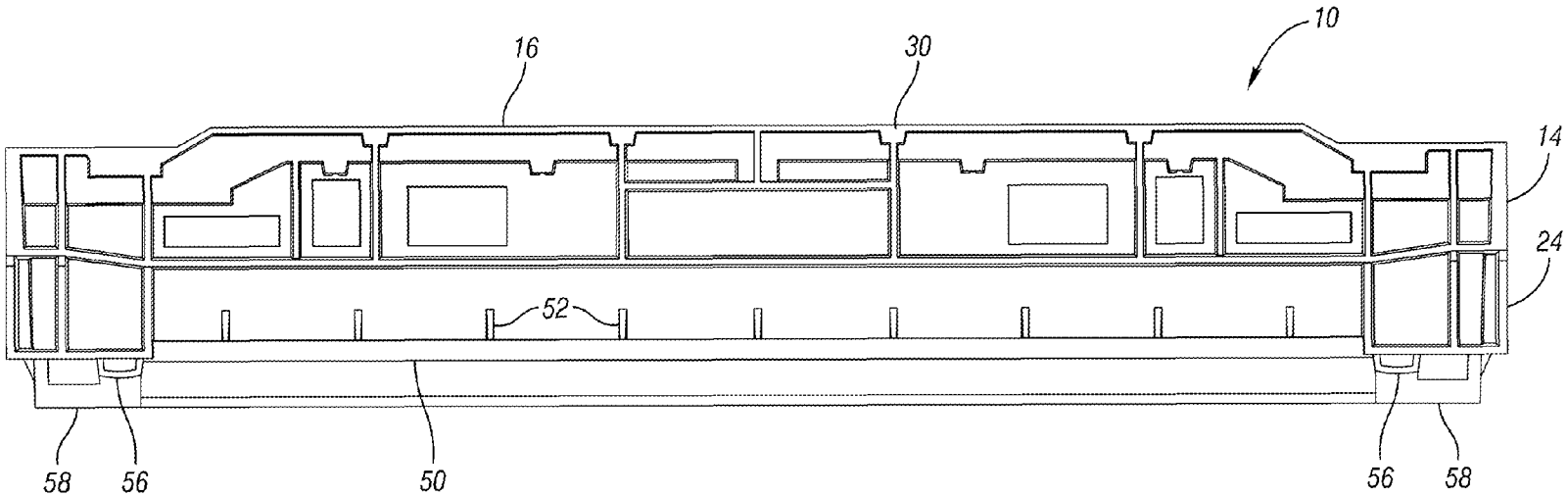
FIG. 3 is a side view of the tray of FIG. 1.

Referring to FIG. 3, the interlocking rail 50 extends continuously between the feet 56 and is reinforced gussets 52.

Figure 4:
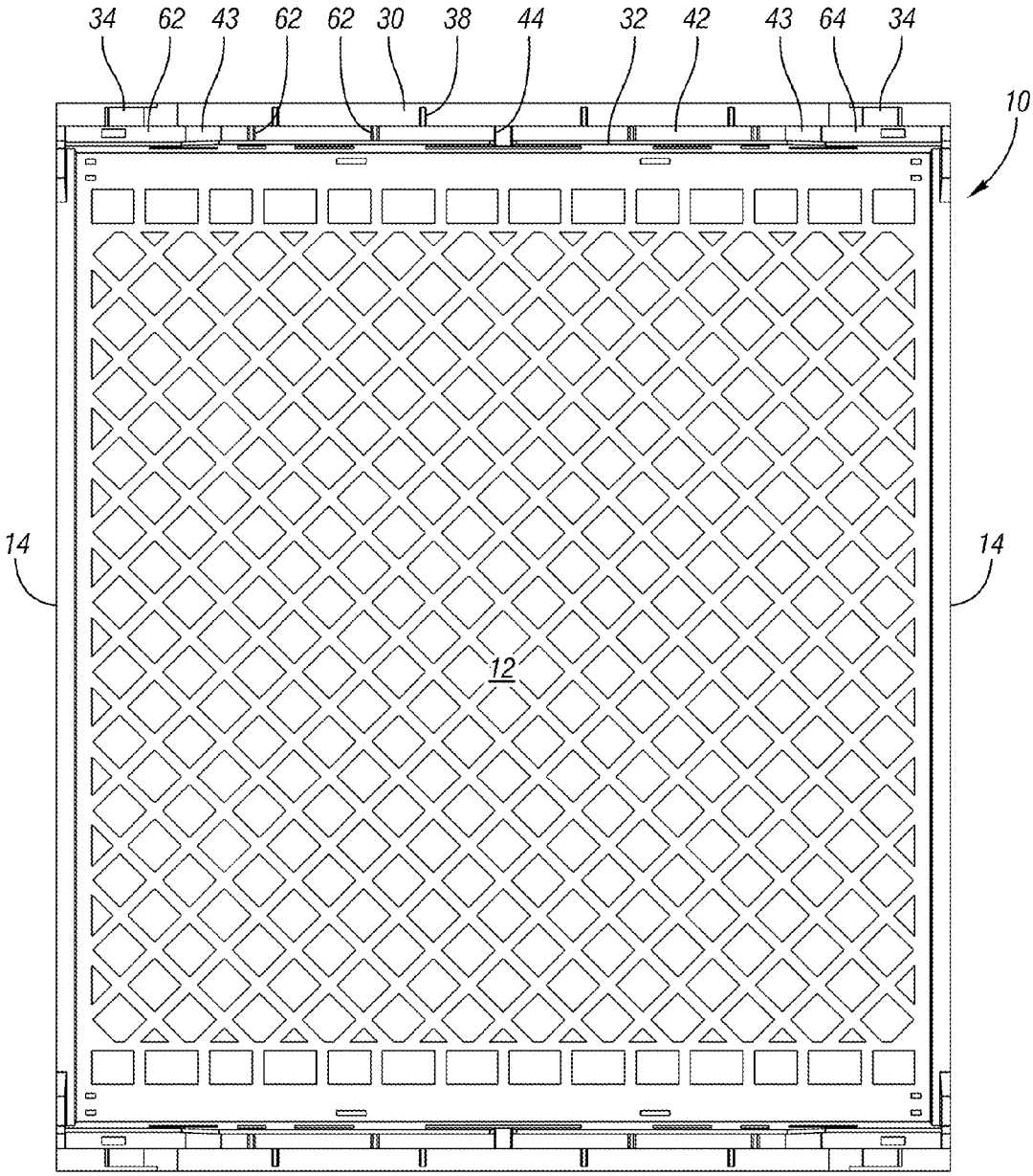
FIG. 4 is a top view of the tray of FIG. 1.

FIG. 4 is a top view of the tray 10. As shown, the bottom surface 42 of the channel between the inner rail 32 and the outer rail 30 includes a plurality of discontinuities 62, such as recesses as shown (projections could also be used). These discontinuities 62 interact with the inner guides 58 of a tray sliding thereon to provide audible feedback that the trays are properly aligned. The lower surface 42, particularly the inclined portion 43, is continuous with recesses 64.

Figure 5:
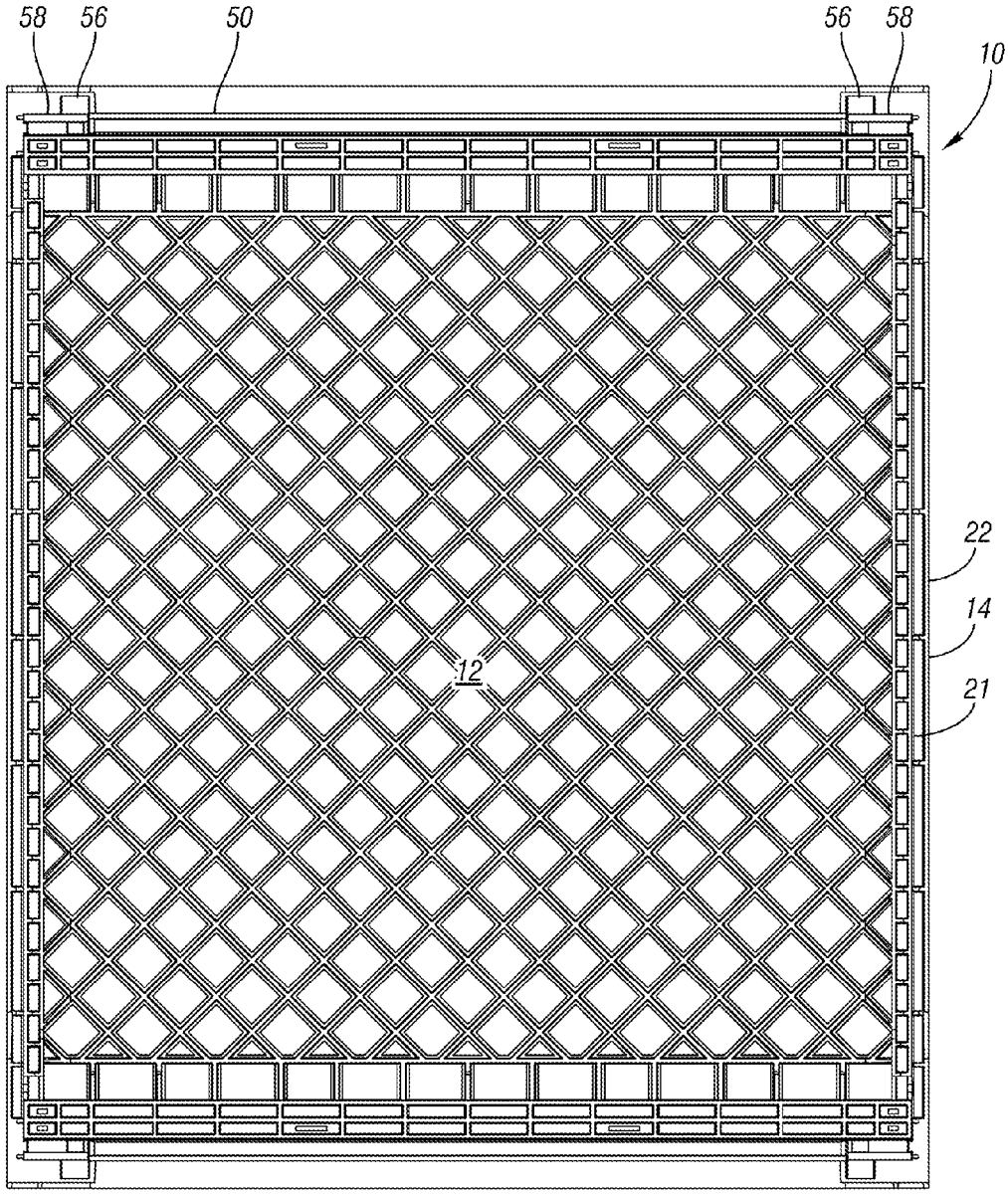
FIG. 5 is a bottom view of the tray of FIG. 1.

FIG. 5 is a bottom view of the tray 10. Ribs connect the inner wall 21 of the front and rear walls 14 to the base 12. Ribs connect the inner wall 21 of the front and rear walls 14 to the outer lip 22. The interlocking rail 50 extends continuously between the feet 56 and inner guides 58.

Figure 6:
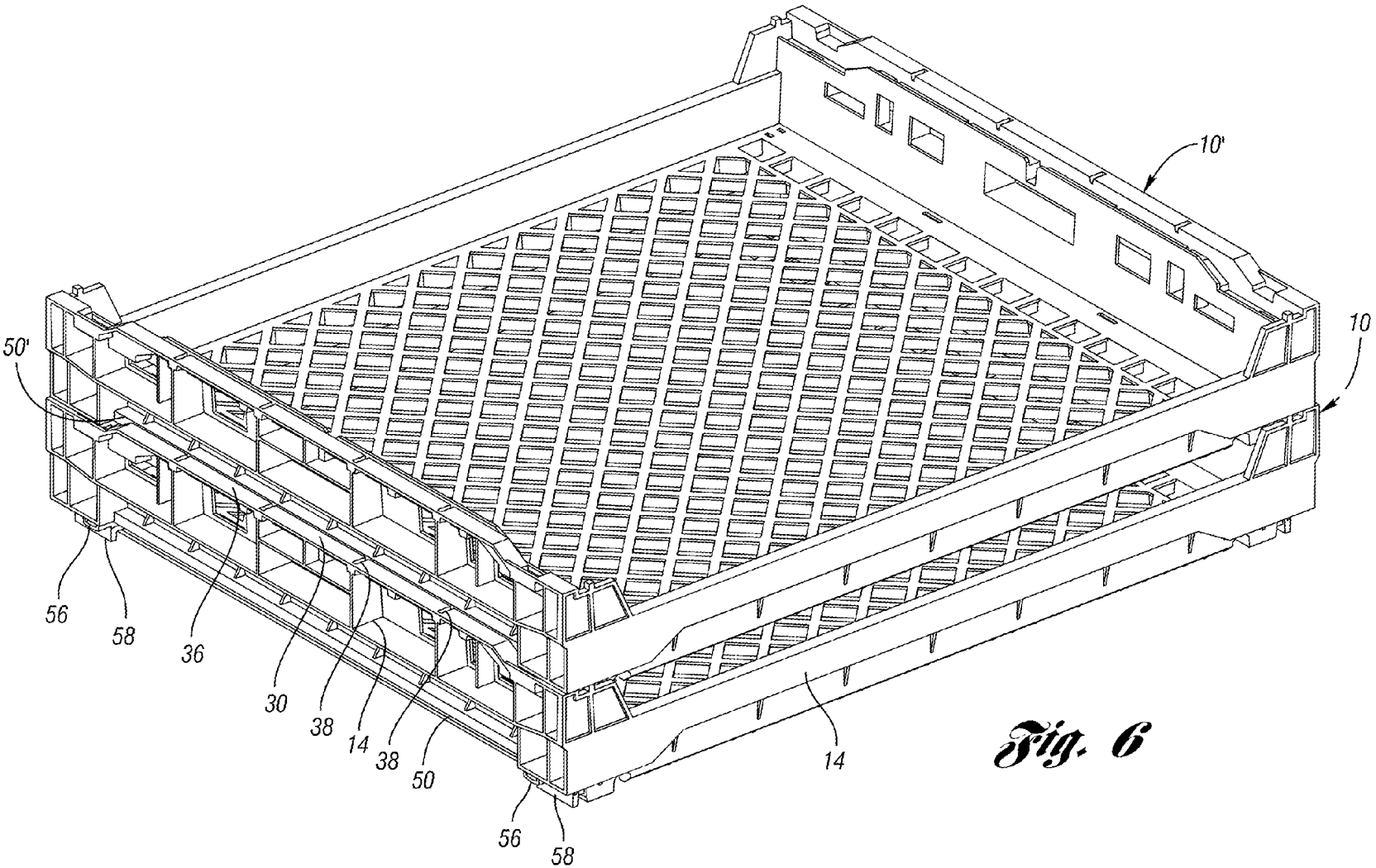
FIG. 6 is a perspective view of the tray of FIG. 1 with a similar tray stacked thereon.

FIG. 6 illustrates the tray 10 with a similar tray 10' stacked thereon. In a blind stacking operation, as the upper tray 10' is first placed on a front edge of the tray 10, the feet 56 (feet 56 of the upper tray 10' are not visible in FIG. 6), slide along an upper surface 36 of the outer rail 30 of the side walls 16. As the feet 56 contact each of the discontinuities 38, a "clicking" sound is made, thereby providing audible feedback that proper alignment has been obtained. The lower surface of each foot 56 is rounded to provide a tapered leading edge that contacts the discontinuities 38 so that the feet 56 do not get stuck on the discontinuities 38. The leading foot 56 rides across the upper surface 36 of the outer rail 30 and down the inclined portion of the outer rail into the interlocking recess 34 (FIG. 1). Simultaneously, the interlocking rail 50' drops into the channel between the outer rail 30 and the inner rail 32.

Figure 7:
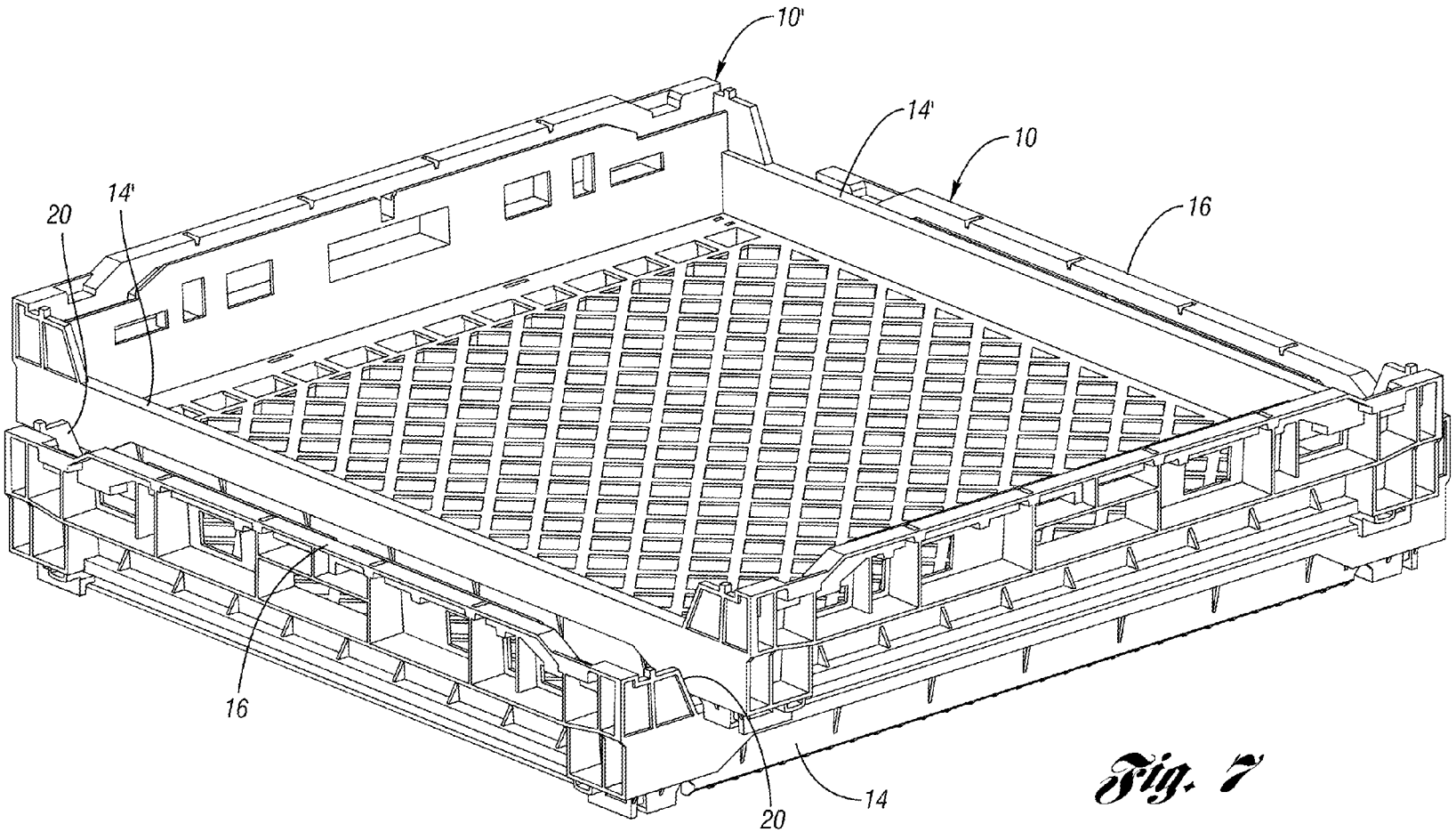
FIG. 7 is a perspective view of the tray of FIG. 1 with the similar tray cross-stacked or nested therewith.

When empty, the trays 10, 10' can be cross-stacked or nested as shown in FIG. 7. This reduces the overall stacking height of the trays 10, 10' when empty for returning to the bakery. The upper tray 10' is rotated 90 degrees relative to the lower tray 10. The front and rear walls 14' fit between the lateral flanges of the side walls 16 of the lower tray 10.

The tray 10 is preferably injection molded of polypropylene, polyethylene or other suitable material. Other suitable processes may also be used.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A tray comprising:

a base;

opposed front and rear walls extending upward from the base; and a pair of opposed side walls extending upward from the base, the side walls each including an outer rail and an inner rail, the outer rail including a plurality of discontinuities, each side wall further including a plurality of feet aligned with the outer rail, such that one of the feet of a like tray sliding thereon would slide on each of the outer rails and provide audible feedback as each foot slides over the plurality of discontinuities on the outer rail during blind stacking.

2. The tray of claim 1 wherein the side walls each include an inner guide extending downward adjacent each of the feet, the inner guide aligned between the outer rail and the inner rail such that the inner guide would be received between an outer rail and an inner rail of a like tray stacked therebelow.

3. The tray of claim 1 wherein a channel defined between the inner rail and the outer rail includes a lower surface having a plurality of discontinuities.

4. The tray of claim 1 wherein the inner rail includes at least one opening into an interior of the tray to drain water from a channel defined between the inner rail and the outer rail, wherein the opening is arranged above a handle through the side wall.

5. The tray of claim 1 wherein the side walls are taller than the front and rear walls, so that access windows are defined above the front and rear walls.

6. The tray of claim 1 wherein an upper edge of the outer rail is higher, relative to the base, than an upper edge of the inner rail.

7. The tray of claim 1 wherein the outer rail is spaced outwardly of the inner rail to define a channel therebetween, the channel having a lower surface that is lower than upper edges of the outer rail and inner rail.

8. A tray comprising:

a base;

a pair of opposed side walls extending upward from the base, the side walls each including an outer rail and an inner rail, the outer rail including a plurality of discontinuities, each side wall further including a plurality of feet aligned with the outer rail, such that the feet of a like tray sliding thereon would slide on the outer rail and provide audible feedback with the discontinuities; and opposed front and rear walls extending upward from the base less than the side walls, the front and rear walls including an inner wall continuous with the base and an outer lip spaced outwardly from the inner wall, the outer lip including enlarged portions proximate the side walls, the enlarged portions partially defining a box beam cross section together with the inner wall, an upper wall portion and a lower wall portion.

9. The tray of claim 8 further including a channel defined between the inner rail and the outer rail, an opening in the inner rail providing a drainage passageway of the channel.

10. The tray of claim 8 further including a pair of lateral flanges extending inwardly from each of the side walls along an upper edge of the front and rear walls.

11. The tray of claim 10 further including a plurality of feet extending downwardly from each of the side walls aligned with the outer rails.

12. A tray comprising:

a base;

opposed front and rear walls extending upward from the base; and a pair of opposed side walls extending upward from the base, the front and rear walls shorter than the side walls, the side walls each including an outer rail and an inner rail defining a channel therebetween, an opening in the inner rail providing a drainage passageway of the channel, wherein the channel is further defined by a lower surface between the outer rail and the inner rail, the lower surface including a central portion, an inclined portion on either side of the central portion and a recess outward of each inclined portion, wherein the inner rail protrudes upwardly relative to the lower surface of the channel along the central portion, along the inclined portions and along the recesses.

13. A tray comprising:

a base;

opposed front and rear walls extending upward from the base; and a pair of opposed side walls extending upward from the base, the side walls each including an outer rail and an inner rail, each side wall further including at least two feet aligned with the outer rail, such that the feet of a like tray sliding thereon would slide on the outer rail, each side wall including an interlocking rail between the at least two feet, the interlocking rail aligned between the inner rail and the outer rail.

14. The tray of claim 13 wherein the interlocking rail extends from one of the at least two feet to another of the at least two feet.

15. The tray of claim 13 wherein an upper edge of the outer rail is higher, relative to the base, than an upper edge of the inner rail.

16. The tray of claim 15 wherein the outer rail is spaced outwardly of the inner rail to define a channel therebetween, the channel having a lower surface that is lower than upper edges of the outer rail and inner rail.

17. The tray of claim 13 wherein the side walls each include an inner guide extending downward adjacent each of the feet, the inner guide aligned between the outer rail and the inner rail such that the inner guide would be received between an outer rail and an inner rail of a like tray stacked therebelow.

18. The tray of claim 17 wherein a channel defined between the inner rail and the outer rail includes a lower surface having a plurality of discontinuities.

19. The tray of claim 18 wherein the inner rail includes at least one opening into an interior of the tray to drain water from a channel defined between the inner rail and the outer rail.

20. The tray of claim 19 wherein the side walls are taller than the front and rear walls, so that access windows are defined above the front and rear walls.

* * * * *